US007929891B2

(12) United States Patent
Tomita et al.

(10) Patent No.: US 7,929,891 B2
(45) Date of Patent: Apr. 19, 2011

(54) ALIGNMENT ERROR CORRECTING UNIT FOR IMAGE FORMING APPARATUS

(75) Inventors: Norio Tomita, Nara (JP); Yoshiteru Kikuchi, Nara (JP); Kenichi Isomi, Nara (JP); Yoshikazu Harada, Nara (JP); Tetsushi Ito, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 125 days.

(21) Appl. No.: 12/416,692

(22) Filed: Apr. 1, 2009

(65) Prior Publication Data

US 2009/0252540 A1 Oct. 8, 2009

(30) Foreign Application Priority Data

Apr. 2, 2008 (JP) ..... 2008-096216

(51) Int. Cl.
*G03G 15/01* (2006.01)

(52) U.S. Cl. ..... 399/301; 399/167

(58) Field of Classification Search ..... 399/301, 399/167, 394, 395, 49; 347/116
See application file for complete search history.

(56) References Cited

U.S. PATENT DOCUMENTS 7,110,687 B2 9/2006 Furukawa
7,209,693 B2 * 4/2007 Tachibana et al. ..... 399/301
2006/0039722 A1 * 2/2006 Ehara ..... 399/301
2007/0071510 A1 * 3/2007 Matsuyama et al. ..... 399/301
2007/0217830 A1 * 9/2007 Matsuda et al. ..... 399/301

FOREIGN PATENT DOCUMENTS

| | | | |
|---|---|---|---|
| JP | 2001-228679 | A | 8/2001 |
| JP | 2004-101655 | A | 4/2004 |
| JP | 2004-294471 | A | 10/2004 |
| JP | 2005-275254 | A | 6/2005 |
| JP | 2006-078850 | A | 3/2006 |
| JP | 2007-34025 | A | 2/2007 |
| JP | 2007-101890 | A | 4/2007 |
| JP | 2007-304558 | A | 11/2007 |
| JP | 2007-310029 | A | 11/2007 |

* cited by examiner

*Primary Examiner* — Sophia S Chen
(74) *Attorney, Agent, or Firm* — Birch, Stewart, Kolasch & Birch, LLP

(57) ABSTRACT

An image forming apparatus include: a plurality of photosensitive drums; a latent image forming unit for forming an electrostatic latent image on each photosensitive drum; a developing unit for developing each electrostatic latent image; a transferring unit for superimposing and transferring the developed images onto a moving record medium; a measurement unit for measuring positions of the transferred images on the record medium; and a control unit for controlling the photosensitive drums, the latent image forming unit, the developing unit, and the transferring unit. The control unit includes: a calculating unit for calculating a value related to alignment errors in the positions measured by said measurement unit in accordance with a sine-curve fitting method; and a correcting unit for correcting the alignment errors by the calculated value.

12 Claims, 17 Drawing Sheets

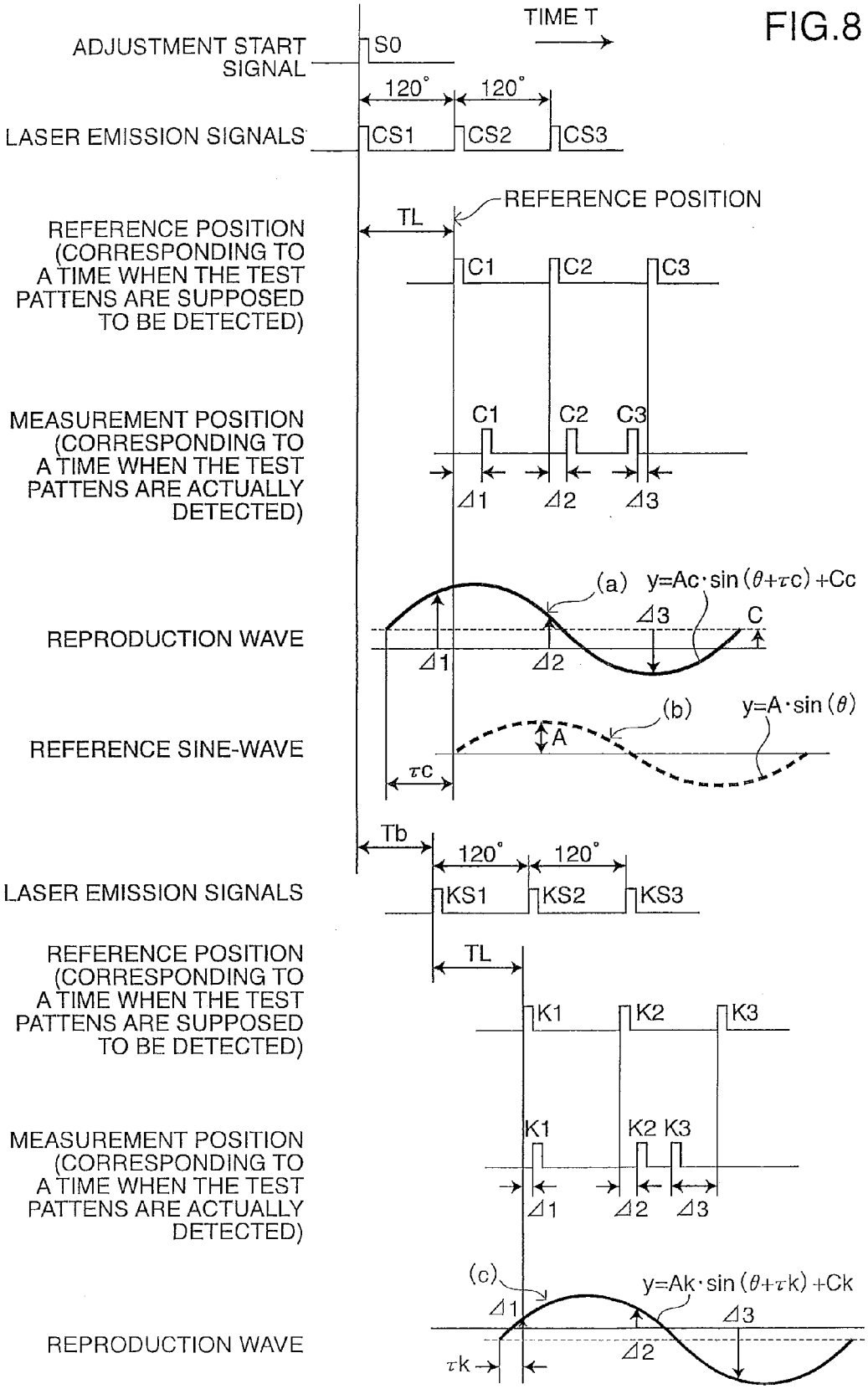
FIG.8
TIME T
ADJUSTMENT START SIGNAL
S0
120°
120°
LASER EMISSION SIGNALS
CS1
CS2
CS3
REFERENCE POSITION
TL
REFERENCE POSITION (CORRESPONDING TO A TIME WHEN THE TEST PATTENS ARE SUPPOSED TO BE DETECTED)
C1
C2
C3
MEASUREMENT POSITION (CORRESPONDING TO A TIME WHEN THE TEST PATTENS ARE ACTUALLY DETECTED)
C1
C2
C3
Δ1
Δ2
Δ3
(a)
y=Ac·sin (θ+τc) +Cc
Δ3
C
REPRODUCTION WAVE
Δ1
Δ2
(b)
y=A·sin (θ)
A
REFERENCE SINE-WAVE
τc
Tb
120°
120°
LASER EMISSION SIGNALS
KS1
KS2
KS3
TL
REFERENCE POSITION (CORRESPONDING TO A TIME WHEN THE TEST PATTENS ARE SUPPOSED TO BE DETECTED)
K1
K2
K3
MEASUREMENT POSITION (CORRESPONDING TO A TIME WHEN THE TEST PATTENS ARE ACTUALLY DETECTED)
K1
K2 K3
Δ1
Δ2
Δ3
(c)
y=Ak·sin (θ+τk) +Ck
Δ1
Δ3
REPRODUCTION WAVE
Δ2
τk

ALIGNMENT ERROR CORRECTING UNIT FOR IMAGE FORMING APPARATUS

CROSS-REFERENCE TO RELATED APPLICATION

This application is related to Japanese patent application No. 2008-96216 filed on Apr. 2, 2008, whose priority is claimed under 35 USC §119, and the disclosure of which is incorporated by reference in its entirety.

BACKGROUND OF THE INVENTION

1. Field of the Invention

The present invention relates to an image forming apparatus and, more particularly, to a color image forming apparatus with a function for correcting alignment errors in the positions of monochromatic images, i.e., color registration errors among the monochromatic images.

2. Description of the Related Art

As a background technology related to the present invention, conventional image forming apparatuses are known which form a multicolored image by superimposing two or more monochromatic images on a record medium after correcting color registration errors of among the monochromatic images. Such image forming apparatuses include image forming means for separately forming monochromatic images on an image carrier, measurement means for measuring the monochromatic images formed on the image carrier, abnormal position storing means for storing positions of the monochromatic images whose measurement information measured by the measurement means is abnormal, and correcting means for correcting the color registration errors based upon the measurement information of the monochromatic images which rest on positions except for the positions stored in the abnormal position storing means (see, for example, Japanese Unexamined Patent Publication No. 2004-294471).

In order to maintain a good property of an image in the conventional color-image forming apparatus, it is necessary to print test patterns regularly and detect a position of each printed test pattern to correct alignment errors in the relative positions at which monochromatic images are formed, that is, correct color registration errors among the monochromatic images. However, it has taken much time to correct such errors, which restrain the apparatus from forming the images. Here, a new technology will be needed to correct such errors during a shorter time period. Further, a toner is consumed for preparing the test patterns. In particular, when rotation phase errors among a plurality of photosensitive drums are corrected, a great number of test patterns are needed to detect the rotation phase. Therefore, there will be a demand for a technology to correct the errors efficiently using a smaller number of test patterns.

SUMMARY OF THE INVENTION

According to the present invention, an image forming apparatus is provided which includes a plurality of photosensitive drums; a latent image forming unit for forming an electrostatic latent image on each photosensitive drum; a developing unit for developing each electrostatic latent image; a transferring unit for superimposing and transferring the developed images onto a moving record medium; a measurement unit for measuring positions of the transferred images on the record medium; and a control unit for controlling the photosensitive drums, the latent image forming unit, the developing unit and the transferring unit, wherein the control unit includes: a calculating unit for calculating a value related to alignment errors in the positions measured by said measurement unit in accordance with a sine-curve fitting method; and a correcting unit for correcting the alignment errors by the calculated value.

Since the sine-curve fitting method is used to calculate the value related to the alignment errors so that the errors are corrected based on the calculated value, the process for correcting the errors can be efficiently performed using a smaller number of test patterns, whereby the time to correct the errors and the amount of the consumed toner can be minimized.

BRIEF DESCRIPTION OF THE DRAWINGS

FIG. 8 is a timing chart for explaining the operation of the image forming apparatus of FIG. 1.

DETAILED DESCRIPTION OF THE INVENTION

Figure 1:
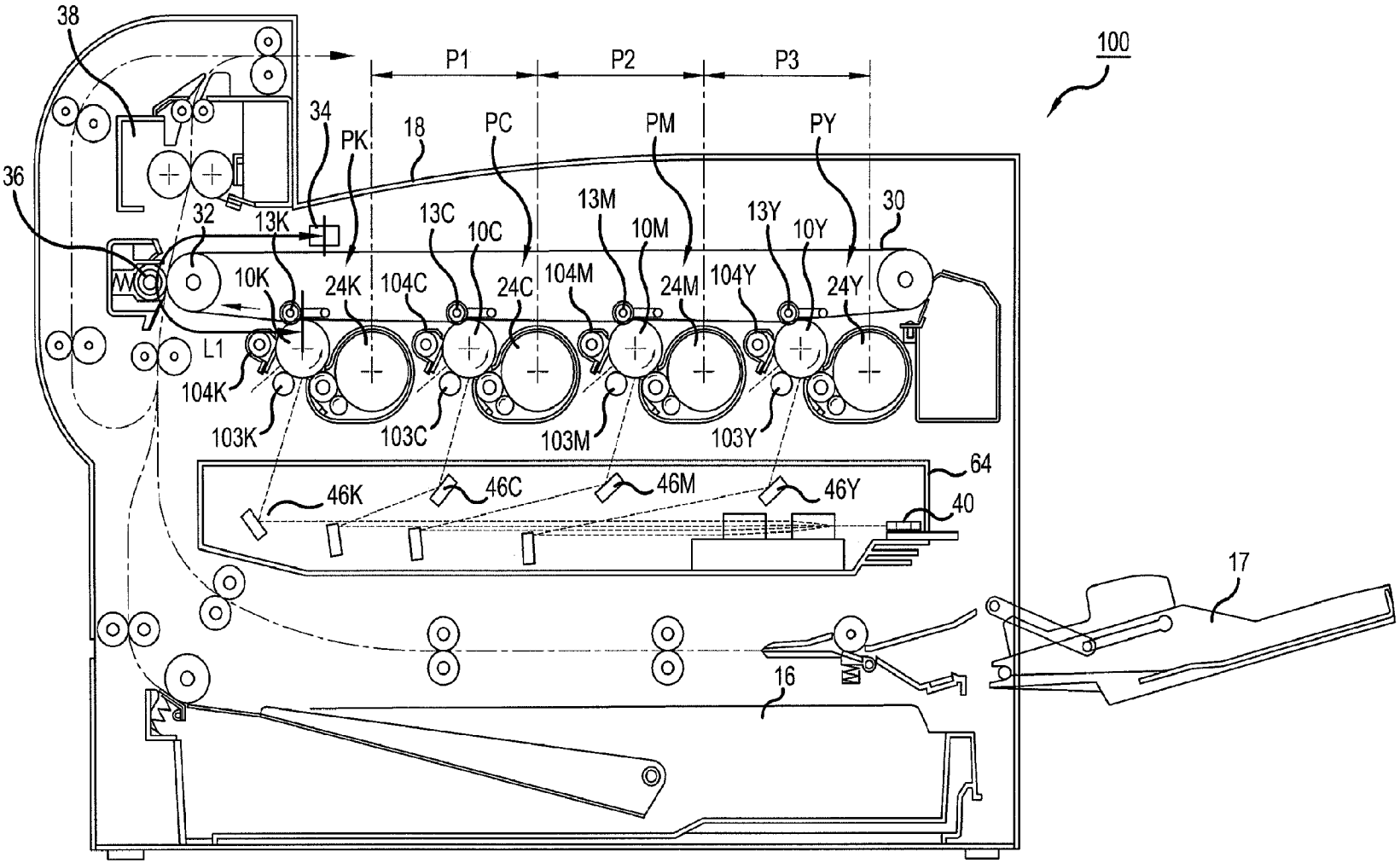
FIG. 1 is an explanation drawing showing a structure of the image forming apparatus according to a preferred embodiment of the present invention.

According to the present invention, an image forming apparatus includes: a plurality of photosensitive drums; a latent image forming unit for forming an electrostatic latent image on each photosensitive drum; a developing unit for developing each electrostatic latent image; a transferring unit for superimposing and transferring the developed images onto a moving record medium; a measurement unit for measuring positions of the transferred images on the record medium; and a control unit for controlling the photosensitive drums, the latent image forming unit, the developing unit and the transferring unit, wherein the control unit includes a calculating unit for calculating a value related to alignment errors in the positions measured by said measurement unit in accordance with a sine-curve fitting method; and a correcting unit for correcting the alignment errors by the calculated value.

The sine-curve fitting method is a method for determining an amplitude (A), a phase difference ($\tau$), and an offset value (C) which are coefficients of a trigonometric function (sine or cosine function), if a set of measurement values are better approximated using the trigonometric function. According to the present invention, a deviation determined from a detection timing of a test pattern as compared with a reference timing is used as the above measurement values. The test pattern is formed on each photosensitive drum and the record medium for correcting color registration errors among monochromatic images, i.e., alignment errors in the relative positions at which the monochromatic images are formed.

According to the present invention, the control unit may allow the latent image forming unit, the developing unit and the transferring unit to carry out the steps of: forming an electrostatic latent image having a test pattern on each photosensitive drum at every predetermined rotation angle; developing each electrostatic latent image; transferring the developed images on the record medium; measuring a position y of each test pattern by the measurement unit; representing the position y using a formula $y=A\sin(\theta+\tau)+C$ ($\theta$ is a rotation angle of each photosensitive drum) in accordance with the sine-curve fitting method to determine $\tau$ and C; and correcting the alignment errors on the record medium based on the determined $\tau$ and C.

Preferably, the predetermined rotation angle is 120°. The plurality of photosensitive drums may include first and second photosensitive drums so that the test patterns are alternatively formed on the moving record medium by the first and second photosensitive drums. The plurality of photosensitive drums may include first, second, third and fourth photosensitive drums so that the test patterns formed by the second, third and fourth photosensitive drums are formed on said moving record medium between the test patterns formed by the first photosensitive drum.

The test patterns may be formed on both of edges of the moving medium in a direction perpendicular to a moving direction of the record medium. The test patterns may slant to a moving direction of the record medium. Each photosensitive drum may be driven by an exclusive driving source. The number of the photosensitive drums may be three so that two of the photosensitive drums other than one are driven by a common driving source.

The inventive image forming apparatus may further include a phase sensor for detecting a rotation phase of each photosensitive drum so that the control unit functions to confirm a correction result of the correcting unit in response to an output of the phase sensor. The inventive image forming apparatus may further include a phase sensor for detecting a rotation phase of each photosensitive drum wherein the control unit functions to correct a correction result of the correcting unit in response to an output of the phase sensor.

The present invention will be described in detail with reference to the accompanying drawings.

Overall Mechanical Structure of the Image Forming Apparatus

FIG. 1 is an explanation drawing showing a structure of the image forming apparatus according to an embodiment of the present invention. An image forming apparatus 100 is a color printer of the electrophotographic type for forming a multicolored image and/or a monochromatic image on a record medium such as a paper sheet in accordance with image data received from an outside source. The image forming apparatus 100 includes an exposure unit 64, four photosensitive drums 10Y, 10M, 10C, and 10K, four developing units 24Y, 24M, 24C and 24K, four charging rollers 103Y, 103M, 103C and 103K, four cleaning units 104Y, 104M, 104C and 104K, an intermediate transferring belt (an intermediate record medium) 30, four intermediate transferring rollers (referred to as "transferring rollers" hereafter) 13Y, 13M, 13C and 13K, a secondary transferring roller 36, a fixing unit 38, a sheet-supply cassette 16, a sheet-supply tray 17 and an exhaust tray 18.

The image forming apparatus 100 is operated to form a multicolored image according to image data corresponding to color components of four-colors which are black (K) and three primary colors of subtractive color mixture, i.e., cyan (C), magenta (M) and yellow (Y). The photosensitive drums 10Y, 10M, 10C, and 10K, the developing units 24Y, 24M, 24C and 24K, the charging rollers 103Y, 103M, 103C and 103K, the cleaning units 104Y, 104M, 104C and 104K corresponding to the four color components constitutes four image forming sections PY, PM, PC and PK. The four image forming sections PY, PM, PC and PK are aligned in a line along a moving direction of the intermediate transferring belt 30 (corresponding to a sub scanning direction). The symbols Y, M, C and K affixed to the numerals of the respective elements are referred to the color components. That is, Y, M, C and K are referred to yellow, magenta, cyan and black, respectively. Therefore, the photosensitive drums 10Y, 10M, 10C and 10K may be referred to as yellow, magenta, cyan and black photosensitive drums, respectively.

The charging rollers 103Y to 103K are a touch type charger for uniformly charging surfaces of the photosensitive drums 10Y to 10K up to a predetermined voltage. In place of the charging rollers 103Y to 103K, a brush type or a non-touch type charger may be available. An exposure unit 64 (referred to as LSU) includes four laser diodes 42Y, 42M, 42C and 42K (FIG. 2), a polygon mirror 40, four reflection mirrors 46Y, 46M, 46C and 46K.

The laser diodes 42Y to 42K correspond to the respective color components. The respective laser diodes emit laser beams modulated by the image data corresponding to the respective color components of black, cyan, magenta and yellow. The respective laser beams are emitted to surfaces of the photosensitive drums 10Y to 10K which are uniformly charged by the charging rollers 103Y to 103K. Thus, electrostatic latent images are formed on the surfaces of the photosensitive drums 10Y to 10K so as to correspond to the image data of the respective four color components. That is, the electrostatic latent images formed on the surfaces of the photosensitive drums 10Y, 10M, 10C and 10K correspond to the image data of the color components of yellow, magenta, cyan and black, respectively.

The developing units 24Y to 24K develop the electrostatic latent images formed on the photosensitive drums 10Y to 10K with toners corresponding to the color components. Therefore, toner images are formed to be visualized on the surfaces of the photosensitive drums 10Y to 10K with the color components. When a monochromatic image is formed, the electrostatic latent image is only formed on the photosensitive drum 10K and a black toner image is only made. When a multicolored image is formed, the electrostatic latent images are respectively formed on the surfaces of the photosensitive drums 10Y, 10M, 10C and 10K and the toner images of yellow, magenta, cyan and black are made.

The intermediate transferring belt 30 is an endless belt to be driven by a belt drive roller 32 which is clockwise rotated. The intermediate transferring rollers 13Y, 13M, 13C and 13K transfer the toner images on the intermediate transferring belt 30 by the action of the transferring voltage applied. The intermediate transferring belt 30 circles along the intermediate transferring rollers 13Y, 13M, 13C and 13K. To make a multicolored image, the intermediate transferring belt 30 travels to superimpose the toner images of yellow, magenta, cyan and black in this order thereon. The secondary transferring roller 36 and the belt drive roller 32 are positioned so as to confront each other to put the intermediate transferring belt 30 therebetween. The superimposed toner images are passed through a transferring position where the secondary transferring roller 36 is located.

The timing between the toner image and a record sheet supplied from the sheet-supply cassette 16 or the sheet-supply tray 17 is synchronized at the transferring section. The supplied record sheet is sandwiched between the intermediate transferring belt 30 and the secondary transferring roller 36 to become contact with the toner image. The secondary transferring roller 36 transfers the toner image onto the record sheet by the action of the secondary transferring voltage applied thereto. The record sheet to which the toner image is transferred is exhausted via the fixing unit 38 to the exhaust tray 18. The fixing unit 38 is adapted to fuse the toner image to fix it on the record sheet while the record sheet is passed through the fixing unit 38.

A photo-sensor 34 is positioned downstream from the photosensitive drum 10K along the moving direction of the intermediate transferring belt 30 so as to face the surface of the intermediate transferring belt 30.

Here, there is a length L1 of 280 mm from a transferring position to the photo-sensor 34. The transferring position is a position where the photosensitive drum 10K and the intermediate transferring belt 30 are contacted.

Figure 2:
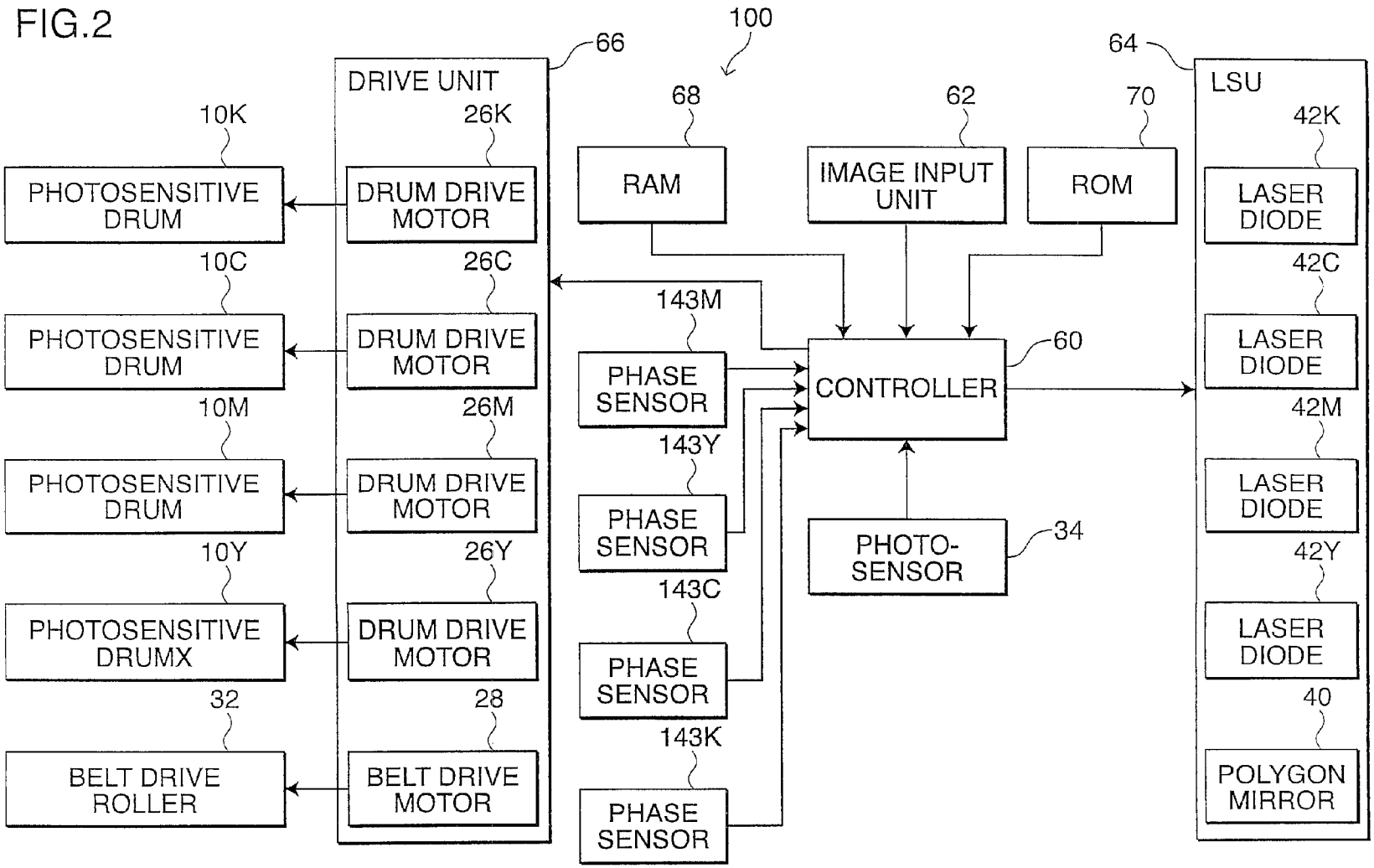
FIG. 2 is a block diagram of the control system of the image forming apparatus as shown in FIG. 1.

FIG. 2 is a block diagram showing a control system of the image forming apparatus as shown in FIG. 1. As shown in FIG. 2, the control system of the image forming apparatus 100 has input means which include the photo-sensor 34 and an image input unit 62. Further, it has control objects which include the LSU 64 and a drive unit 66. A controller 60, a RAM 68 and a ROM 70 are provided for processing signals or data from the input means and control the control objects. In addition, it drives loads which include the photosensitive drums 10K, 10C, 10M and 10Y, the belt drive roller 32, the polygon mirror 40 of the LSU 64.

The photo-sensor 34 is a sensor for reading a test pattern formed on the intermediate transferring belt 30, as mentioned later. The image input unit 62 is provided for obtaining image data from an outside source. The source for providing the image data is an instrument connected to the image forming apparatus 100 via a communication line. An example of such an instrument is a host such as a personal computer. Another example is an image scanner. The image data obtained is stored in the RAM 68 for printing processes.

Typically, the controller 60 include a CPU or a microcomputer. The RAM 68 provides a working area for the controller 60 and an image memory region for storing the image data. An information data showing an attribute is affixed to the image data obtained by the image input unit 62. The affixed attribute includes an image size containing length and width, a classification indicating a monochromatic image, a multicolored image, and the like.

The controller 60 stores the obtained image data into the RAM 68 corresponding to the affixed attribute. The image data are stored in the RAM 68 in job unit form. When a job includes a plurality of pages, the job is stored in page units. When the image data are input in a format of a page descriptive language from the outside host, the controller 60 is operated to develop the input image data and store it in the image memory region.

A ROM 70 stores a program which defines processes performed by the controller 60. Further, the ROM 70 stores pattern data of producing a test pattern. The controller 60 drives various drive loads as shown in FIG. 2. In addition, it also controls various elements not shown in FIGS. 1 and 2.

The LSU 64 receives signals (pixel signals) according to the image data stored in the image memory region in the RAM 68 via an image process unit not shown. The image process unit processes the image data to provide modulating signals toward the LSU 64 corresponding to pixels of the images to be output. The modulating signals are provided to each of the color components of yellow, magenta, cyan and black. The modulating signals corresponding to yellow are used to modulate an emission beam from the laser diode 42Y in the LSU 64. The modulating signals corresponding to magenta, cyan and black are used to modulate emission beams from the laser diodes 42M, 42C and 42K in the LSU 64, respectively.

The drive unit 66 includes drum drive motors 26K, 26C, 26M and 26Y for respectively driving the photosensitive drums 10K, 10C, 10M and 10Y, and a belt drive motor 28 for driving the belt drive roller 32. The belt drive motor 28 is provided for driving the belt 30 via the belt drive roller 32. Further, the drive unit 66 includes a motor (not shown) for driving the polygon mirror 40. The drive unit 66 also controls the motors for driving the photosensitive drums and the intermediate transferring belt so that their peripheral surfaces are driven at an equal constant speed.

Correction for the Color Registration Errors

The controller 60 obtains pattern data which are previously stored in the ROM 70 and develops the obtained pattern data in the image memory region to prepare test patterns. Then, the controller 60 transfers the developed pattern data to the LSU 64. The laser diode receives the data corresponding to each color component to form an electrostatic latent image of the test pattern on the corresponding photosensitive drum.

The developing units 24Y to 24K develop the electrostatic latent image patterns and form toner image test patterns. The toner image patterns corresponding to the color components are transferred onto the intermediate transferring belt 30 and passed between the secondary transferring roller 36 and the belt drive roller 32 toward the photo-sensor 34. The photo-sensor 34 is used to read the test pattern of each color component on the belt 30. The controller 60 corrects color registration errors in accordance with the information of the test pattern of each color component.

An example of the correction of the color registration errors will be described below. The controller 60 reads a detection timing of the test pattern of each color component detected by the photo-sensor 34 to determine a deviation between the detection timing and a reference timing. The determined deviation can be converted into a deviation of the position of the test pattern using the moving speed of the peripheral surface of the intermediate transferring belt 30. It is possible that the controller 60 determines a particular color component as a reference color and the test pattern of the reference color is used for calculating the deviation. To form the test pattern, the controller 60 controls the laser diode 42 of each color component to expose each of the photosensitive drums 10Y-10K.

As shown in FIG. 1, a distance between the axes of the photosensitive drums 10K and 10C is P1. Another distance between the axes of the photosensitive drums 10C and 10M is P2. The other distance between the axes of the photosensitive drums 10M and 10Y is P3. In this embodiment, the distances P1, P2 and P3 are 100 mm, and the photosensitive drums 10Y-10K each have a diameter of 30 mm.

Figure 3:
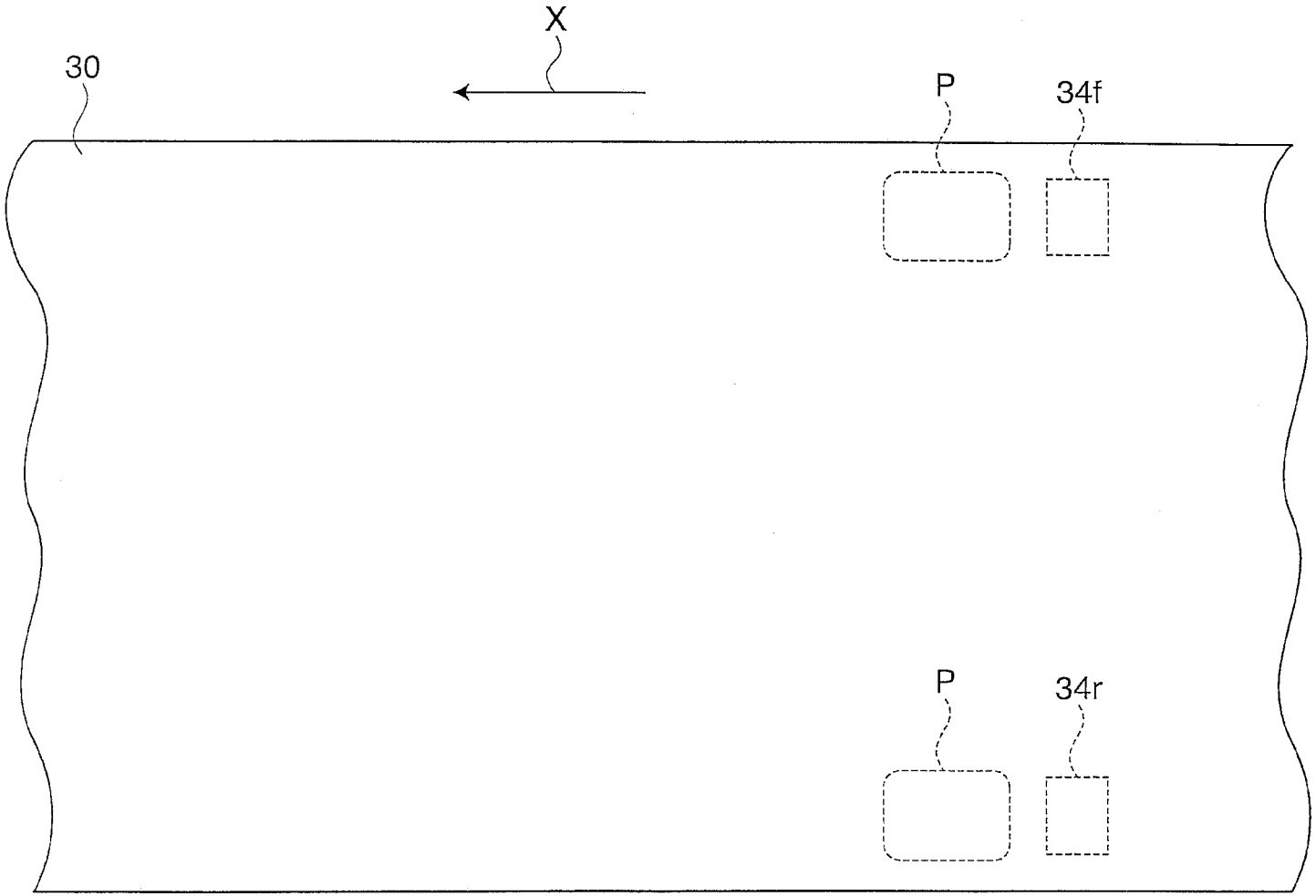
FIG. 3 is an explanation drawing of the primary part of the image forming apparatus of FIG. 1.

As an example, the controller 60 obtains a position of the test pattern of each color component as follows. FIG. 3 is a top view of the intermediate transferring belt 30, which shows an example of the test pattern formed on the intermediate transferring belt 30. The intermediate transferring belt 30 is moved in an arrow direction X. FIG. 3 shows a pair of photo-sensors 34*f* and 34*r*, which composes the photo-sensor 34 shown in FIG. 1. They are a reflection type photo-sensor and positioned so as to confront the surface of the intermediate transferring belt 30. The photo-sensors 34*f* and 34*r* are aligned in a line extending in the width direction (in the main scanning direction), and confronted with a pair of test patterns P formed on the both edges of the intermediate transferring belt 30 or a test pattern P formed on either of the both edges.

A method of correcting the color registration errors using the test pattern will be now described below. Here, the term "color registration errors" means "color registration errors among monochromatic images" and the term "alignment errors" means "alignment errors in the relative positions at which the monochromatic images are formed". The image forming apparatus 100 measures the following three factors resulting in the color registration errors to correct the errors based on measurement results.

1. The Phase Shift of the Photosensitive Drums (AC Component of the Sub Scanning Direction)

According to the present invention, each photosensitive drums has a reference phase. A phase shift (τ) from the reference phase is determined. The phase of each photosensitive drum is adjusted based on the determined phase shift. Specifically, the phase shift is adjusted by shifting each rotation angle of the photosensitive drums when the photosensitive drums are stopped.

2. The Alignment Errors in the Sub Scanning Direction (DC Component in the Sub Scanning Direction)

According to the present invention, the alignment errors in the sub scanning direction can be calculated as a value C according to the sine-curve fitting method by measuring the position of the test pattern extending parallel to the main scanning direction. These errors are considered to result from the thermal expansion of the light exposure element such as the polygon mirror 40 mainly. These errors can be corrected by varying the start timing of the sub scanning line for each monochromatic color.

3. The Alignment Errors in the Main Scanning Direction (DC Component of the Main Scanning Direction)

According to the present invention, the alignment errors in the main scanning direction can be calculated by measuring the position of a slant pattern used as the test pattern, calculating the alignment errors in the main scanning direction and the sub scanning direction according to the sine-curve fitting method, and subtracting the above value C from the calculated alignment errors. These errors are also considered to result from the thermal expansion of the light exposure element such as the polygon mirror 40 mainly. These errors can be corrected by varying the emission start timing of each of the laser diodes 42K-42Y.

Figure 4:
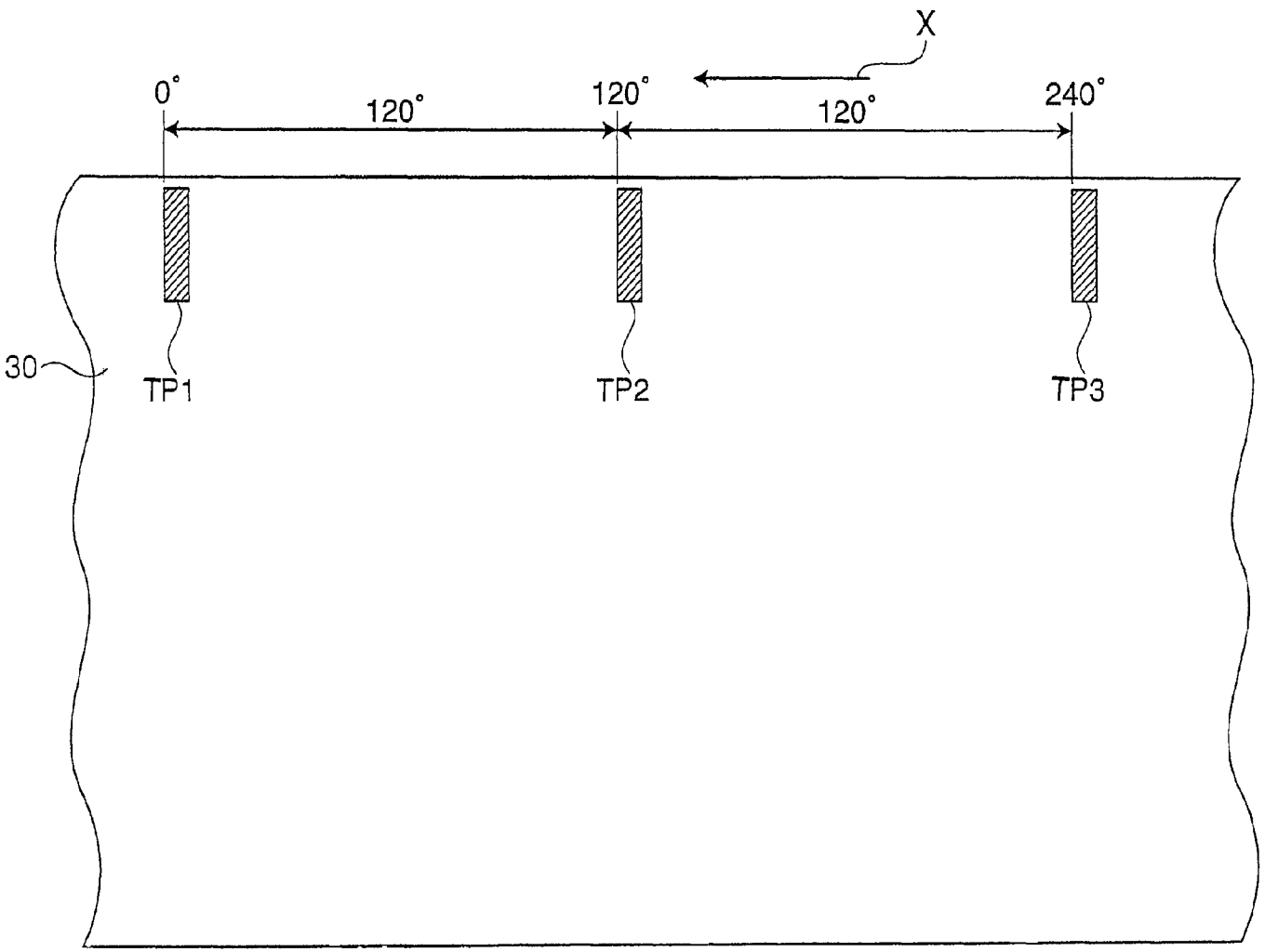
FIG. 4 is an explanation drawing of the primary part of the image forming apparatus of FIG. 1.

FIG. 4 shows a typical example of the test patterns according to this embodiment. As shown in FIG. 4, three test patterns TP1, TP2 and TP3 are formed along the moving direction X of the transferring belt 30 at every 120° in the rotation angle of the photosensitive drum. In this embodiment, the number of the test patterns is three as a minimum. However, it may be four or more.

Adjustment of the Rotation Phase

Figure 7:
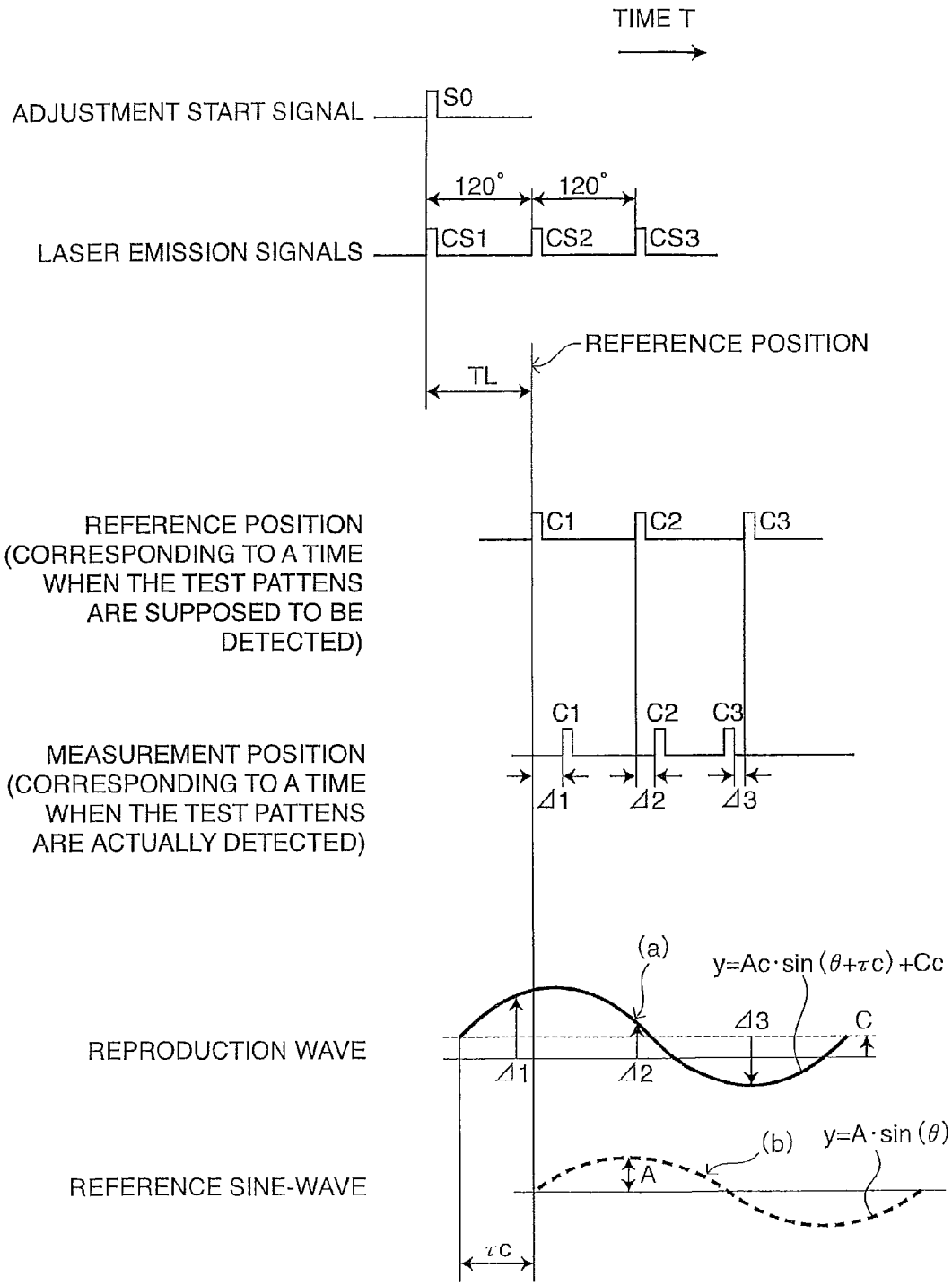
FIG. 7 is a timing chart for explaining the operation of the image forming apparatus of FIG. 1.

The following is a detail explanation of the AC component in the sub scanning direction as the first factor of the alignment errors, and the adjustment of the rotation phase with reference to FIGS. 7 and 8. The monochromatic image formed on each photosensitive drum contains a pitch variation component caused by the eccentricity in the rotation axis of each photosensitive drum. If there is a disagreement among the pitch variations, this results in the color registration errors among the monochromatic images.

FIG. 7 is a timing chart of the signals in the photosensitive drum 10C. Although the angles and the distances coexist in FIG. 7, they can be converted into time. An adjustment start signal $S_0$ is a start reference signal output from the controller 60 at an arbitrary timing.

The signal $S_0$ allows laser emission signals CS1, CS2 and CS3 to be generated at every rotation angle 120° of the photosensitive drum 10C. The laser emission signals CS1, CS2 and CS3 correspond to strip-shaped test patterns TP1, TP2 and TP3 as shown in FIG. 4.

As shown in FIG. 7, the reference positions correspond to times when detection signals C1, C2 and C3 of reference test patterns are supposed to be detected. The signal C1, C2 and C3 are delayed by a delay time TL from the laser emission signals CS1, CS2 and CS3, respectively. The delay time TL corresponds to a sum of a time period when the photosensitive drum 10C rotates from the exposure position by the laser beam to the transferring position, and another time period when the transferring belt 30 travels from the transferring position for the cyan image to the photo-sensor 34 (see, FIG. 1).

The measurement positions in FIG. 7 correspond to times when the detection signals C1, C2 and C3 for the cyan test pattern are actually detected, and difference values from the reference test patterns are represented by Δ1, Δ2 and Δ3. A reproduction wave (a) is a wave obtained by calculating the sine-curve fitting formula based on Δ1, Δ2 and Δ3, and it is represented by $$y=Ac\sin(\theta+\tau c)+Cc.$$

A reference sine-wave (b), y=A sin θ is drawn in order to show a comparison object indicating the phase difference τc different from the reproduction wave (a). In the reference sine-wave (b), the reference position corresponds to θ=0.

FIG. 8 is a timing chart of signals in the cyan and the black photosensitive drums 10C and 10K. With respect to the signals in the cyan photosensitive drum 10C, the timing chart in FIG. 8 is identical with that in FIG. 7.

In this embodiment, when the test patterns are formed on the transferring belt 30 from the black and cyan photosensitive drums under the condition that there is not a phase difference between the both drums, the test patterns are superimposed so that the photo-sensors 34*f* and 34*r* cannot detect them individually. Therefore, adjacent test patterns are spaced by 3 mm, for example. That is, a space between the adjacent cyan and black test patterns is 3 mm. Therefore, as shown in FIG. 8, the laser emission signals KS1, KS2 and KS3 for black are output after a time of Tb from the adjustment start signal $S_0$. The time Tb is given by calculating the subtraction of the space (3 mm) between the adjacent test patterns from the distance P1 of the photosensitive drums (FIG. 1) and dividing the calculated value by the process speed V.

A reference position of the black photosensitive drum 10K corresponds to a timing when detection signals K1, K2 and K3 for the reference test patterns are supposed to be detected. They are delayed by a delay time TL from the laser emission signals KS1, KS2 and KS3, respectively. The measurement positions correspond to times when the detection signals K1, K2 and K3 for the black test pattern are actually detected, and difference values from the reference test patterns are represented by Δ1, Δ2 and Δ3.

A reproduction wave (c) is a wave obtained by calculating the sine-curve fitting formula based on Δ1, Δ2 and Δ3, and it is represented by $y=Ak\sin(\theta+\tau k)+Ck$.

In addition, a value $\phi$ is given by converting the space between the test patterns into the rotation angle. As described above, when the space between the cyan and black test patterns is 3 mm and the photosensitive drum has a diameter of 30 mm, the value $\phi$ is about 11.5°. The black test pattern starts to be printed faster by the value $\phi$, so that the black and cyan test patterns are not superimposed. Therefore, in case where the black test patters PK1 to PK3 are first formed and then the cyan test patters PC1 to PC3 are secondly formed, they has no phase shift when $\tau c=\tau k+\phi$.

On the other hand, if the phase shift occurs, so that $\tau k$ is +30°(+ is denoted if the reproduction wave is shifted leftward in the drawing as compared with the reference sine-wave and − is denoted if the reproduction wave is shifted rightward in the drawing as compared with the reference sine-wave) and $\tau c$ is +50°, then $50°+\sigma=30°+11.5°$ because $\phi=11.5°$. The angle $\sigma$ of the phase shift is −8.5°. This means that the cyan photosensitive drum 10C leads in phase by an angle $\sigma$ or the black photosensitive drum 10K leads in phase by an angle $\sigma$. Therefore, in order to change the phase shift angle to zero, it is necessary that the cyan photosensitive drum 10C is shifted backward in phase by 8.5°, or the black photosensitive drum 10K is shifted forward in phase by 8.5°.

Here, since black is a color which is preferably used when a letter is printed, in order to reduce the color registration errors in the letter-printed documents, it is preferred that the black photosensitive drum is not shifted in phase and the other photosensitive drums such as the yellow, magenta and cyan photosensitive drums are shifted in phase. This is a case where the cyan and black photosensitive drums are used. The yellow and magenta photosensitive drums may be used similarly. The rotation phase of each photosensitive drum is adjusted by changing the stopping timing of the drum drive motor after forming the image. The adjustment of the rotation phase will be described below.

Adjustment of the Rotation Phase of the Photosensitive Drum

Figure 9A:
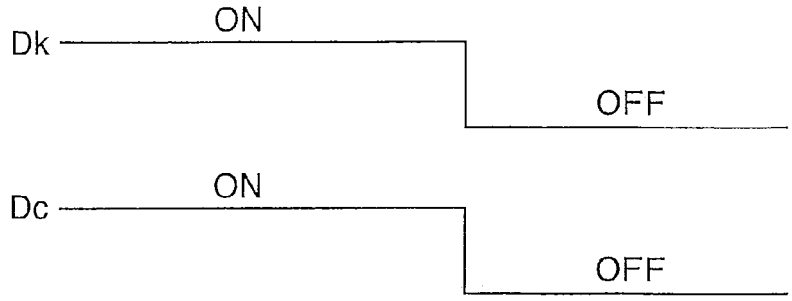
FIGS. 9(*a*)-9(*c*) are timing charts for explaining the operation of the image forming apparatus of FIG. 1.
Figure 9B:
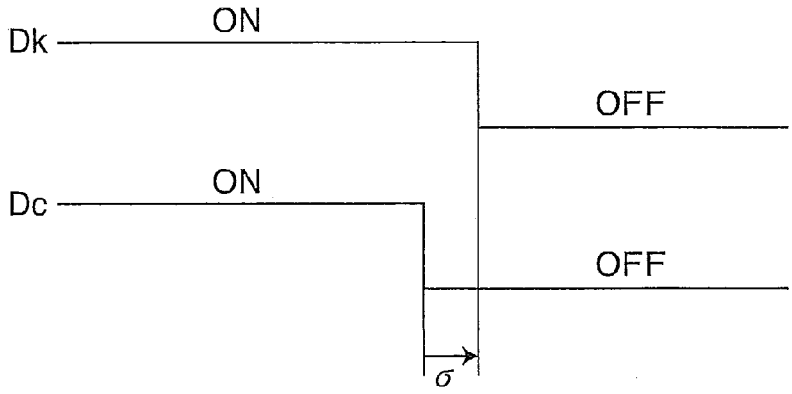
Figure 9C:
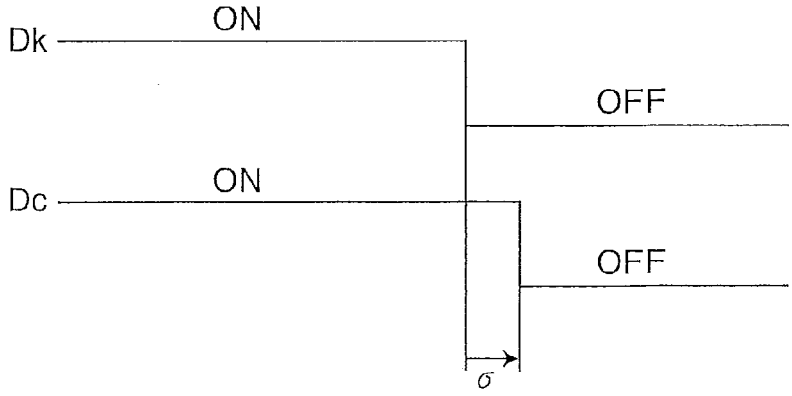

With reference to FIG. 9, the method for adjusting the rotation phase of each photosensitive drum will be described in detail. If the rotation phase of the black photosensitive drum 10K agrees with that of the cyan photosensitive drum 10C, both of the photosensitive drums 10K and 10C are stopped at the same time by the control that the drive signals Dk and Dc are switched from ON to OFF at the same time as shown in FIG. 9(*a*). In the normal operation, they are stopped at the same time, since their phase agree with each other. Otherwise, after either of the photosensitive drums is stopped and another photosensitive drum is rotated at n round (n is an integer), the another photosensitive drum is stopped. This permits them to be stopped without changing their phase relation.

If the rotation phase of the cyan photosensitive drum 10C leads by an angle of $\sigma$ in comparison with that of the black photosensitive drum 10K, the phase shift may adjusted by stopping the cyan photosensitive drum 10C earlier by the angle of $\sigma$ than the black photosensitive drum 10K as shown in FIG. 9(*b*). Otherwise, if the rotation phase of the cyan photosensitive drum 10C is lagged from that of the black photosensitive drum 10K by an angle of $\sigma$, the phase shift may be adjusted by stopping the cyan photosensitive drum 10C later by the angle of $\sigma$ than the black photosensitive drum 10K as shown in FIG. 9(*c*). Further, after either of the photosensitive drums is stopped and the other photosensitive drum is rotated by n round (n is an integer), the phase of the other photosensitive drum may be adjusted by the angle of a as mentioned above.

Figure 6:
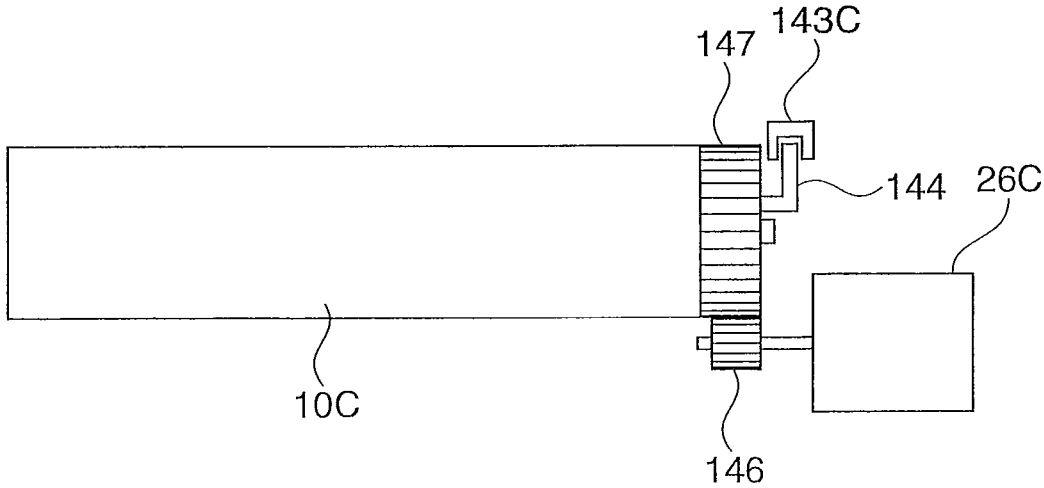
FIG. 6 is an explanation drawing of driving system for the photosensitive drum of the image forming apparatus of FIG. 1

FIG. 6 is an explanation drawing of the cyan photosensitive drum 10C which is one of the photosensitive drums 10Y to 10K, and a driving mechanism of the drum drive motor 26C for driving the photosensitive drum 10C. A driven gear 147 is integrally provided with a flange of the photosensitive drum 10C at an end thereof.

The rotation of the drum drive motor 26C is controlled by the controller 60 (FIG. 2). A drive gear 146 is fixed at on output axis of the drum drive motor 26C. The drive gear 146 is engaged with the drive gear 147.

A phase sensor 143C is arranged for detecting a rotation phase of the photosensitive drum 10C to generate a reference signal. A projection 144 is extended from the driven gear 147. The phase sensor 143C generates the reference signal every time the projection 144 passes through the phase sensor 143C. For example, a photo-interrupter may be used for the phase sensor 143C. The reference signal is input into the controller 60. Similarly, phase sensors 143K, 143M and 143Y (see, FIG. 2) are provided for the other photosensitive drums 10Y, 10M and 10K to detect their rotation phases.

Figure 10:
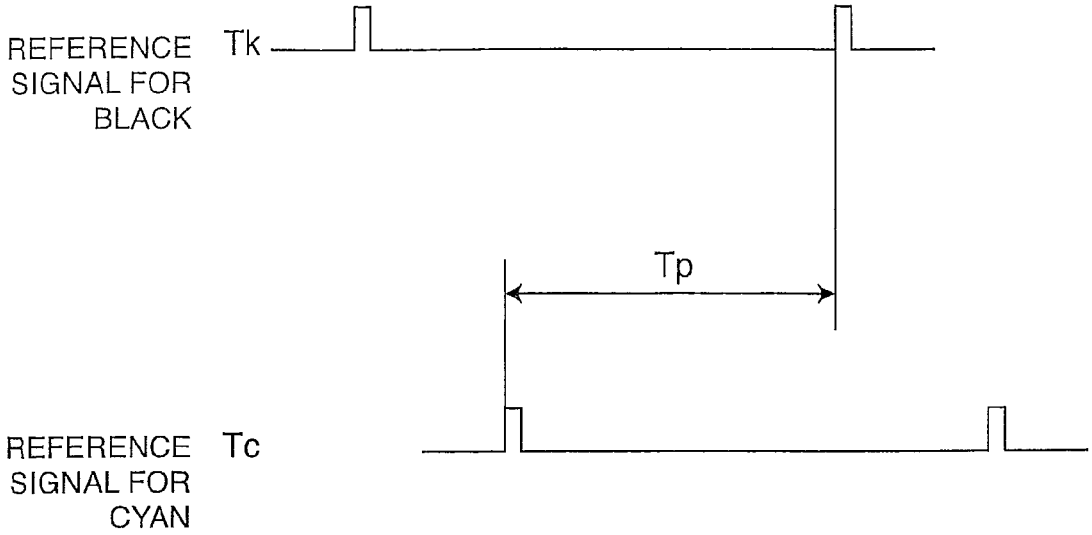
FIG. 10 is a timing chart for explaining the operation of the image forming apparatus of FIG. 1.

FIG. 10 is a timing chart of the reference signal output from the phase sensor 143 of FIG. 6. Before the rotation phase is adjusted, a difference time Tp is measured which represents the difference between the reference signal Tk of the black photosensitive drums 10K and the reference signal Tc of the cyan photosensitive drum 10C. After the rotation phase is adjusted, the difference time Tp is measured again. By comparing the times Tp before and after the adjustment, it is possible to determine whether the adjustment of the rotation phase is accurately performed or not. If the time Tp after adjustment is not changed by a predetermined time as compared with the time Tp before the adjustment, the difference between the times Tp before and after the adjustment is further calculated to accurately adjust the rotation phase.

Calculation Formulas for the Sine-Curve Fitting Method

Figure 11:
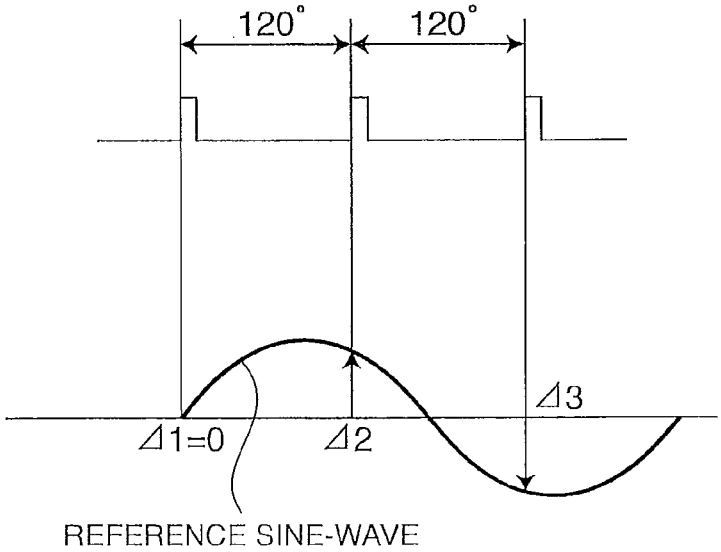
FIG. 11 is a timing chart for explaining the operation of the image forming apparatus of FIG. 1.

FIG. 11 shows positions where a sum of the reference sine-wave is zero in sampling points of the test patterns. For example, three test patterns are formed at every rotation angle of 120° (0°, 120° and 240°) of the photosensitive drum. This may minimize the number of the test patterns and the distance between the test patterns. In another embodiment, four test patterns may be formed at every rotation angle of 90° (0°, 90°, 180° and 270°) of the photosensitive drum.

The description that the sum of the reference sine-wave are zero in the sampling points means that, in the embodiment of FIG. 11, the sum of the deviation Δ1, Δ2 and Δ3 in the reference sine-wave in the sampling points becomes zero. In the embodiment of FIG. 11, the deviation at 0° is 0, the deviation at 120° and the deviation at 240° have a relation of $\Delta 2=-\Delta 3$. Thus, $\Delta 1+\Delta 2+\Delta 3=0$. By performing the sampling under such a condition, the value C, as below mentioned, can be conveniently calculated from the mean value of the deviation Δn. Using the sine-curve fitting method, the phase differences and the amplitudes can be calculated in the minimum time with the minimum number of the test patterns.

The reproduced waves (y=f(θ) hereinafter) as shown in FIGS. 7 and 8 are represented by the following formula.

$$y=f(\theta)=a\sin(\theta)+b\cos(\theta)+c=A\sin(\theta+\tau)+C \quad (1)$$

The values a, b, C, A and τ of the formula (1) are calculated from the deviation Δn(=Δ1, Δ2, Δ3) of the test patterns K1, K2, K3 and θn(θ1=0, θ2=120°, θ3=240°) using the following formulas. The values of Δ1, Δ2, Δ3 are represented using the value At detected as the time difference with respect to the reference position.

The values of Δ1, Δ2, Δ3 may be calculated by converting the product of the value Δt and the belt carrying speed V into the distance ΔL. The distance ΔL is represented by the number of the dots, when the distance ΔL is divided by the size of one dot (about 42 μm). If the distance ΔL is represented by the number of dots, the amplitudes and the values of the color registration errors may be calculated in the number of the dots. Therefore. it may be very easy and convenient to check the test patterns with the calculation results when the test patterns are printed out for visual judgment. The values a, b and C are given by the following formulas.

$$a=\frac{\sum_n(\sin(\theta n)\times\Delta n)}{\sum_n\sin(\theta n)^2} \quad (2)$$

$$b=\frac{\sum_n(\cos(\theta n)\times\Delta n)}{\sum_n\cos(\theta n)^2} \quad (3)$$

$$C=\frac{\sum_n(\Delta n)}{N} \quad (4)$$

Here, N is the number of the test patters. In this embodiment, N is 3.

Figure 5:
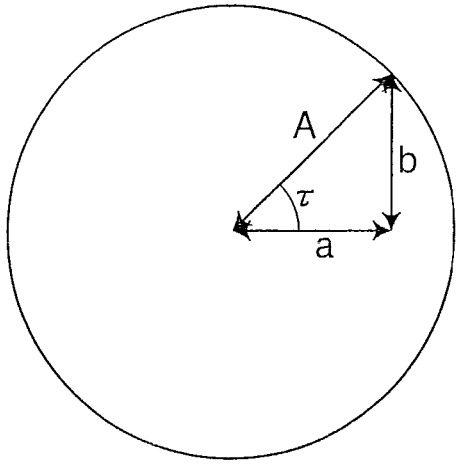
FIG. 5 is an explanation drawing for a method of controlling the image forming apparatus of FIG. 1.

As shown in FIG. 5, the amplitude A is represented by the following formula.

$$A=\sqrt{a^2+b^2}$$

The phase difference τ is calculated by the following formula and formulas of Table 1.

$$\tau 1=\arcsin(b/A)$$

Figure 18:
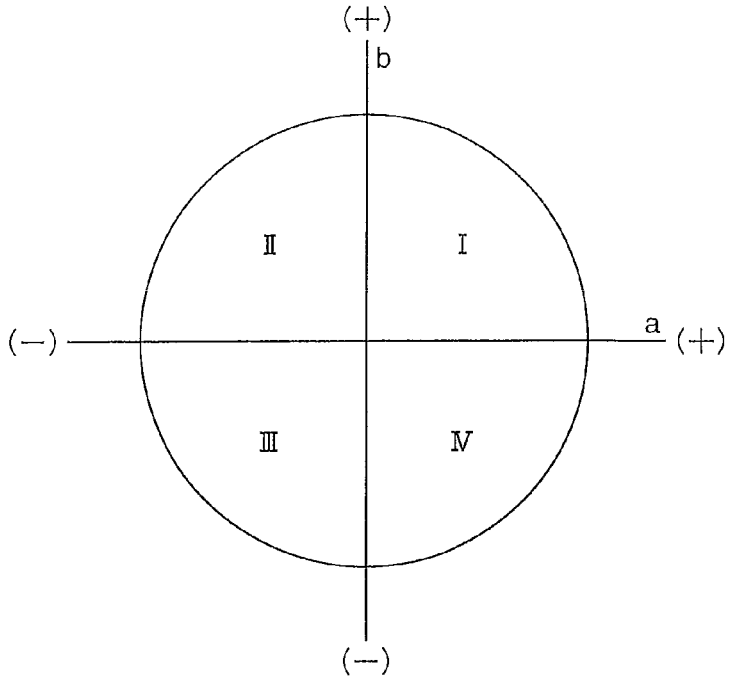
FIG. 18 is an explanation drawing of the sine-curve fitting method according to the present invention.

The reason is that it is necessary to convert a and b corresponding to I to IV quadrants of FIG. 18.

The region of the value τ is as follows.

$$0°\leqq\tau<360°$$

TABLE 1

| Quadrant | a | b | Formula |
|---|---|---|---|
| I | + | + | τ = τ1 |
| IV | + | − | τ = τ1 + 360° |
| II | − | + | τ = −τ1 + 180° |
| III | − | − | |

Figure 19:
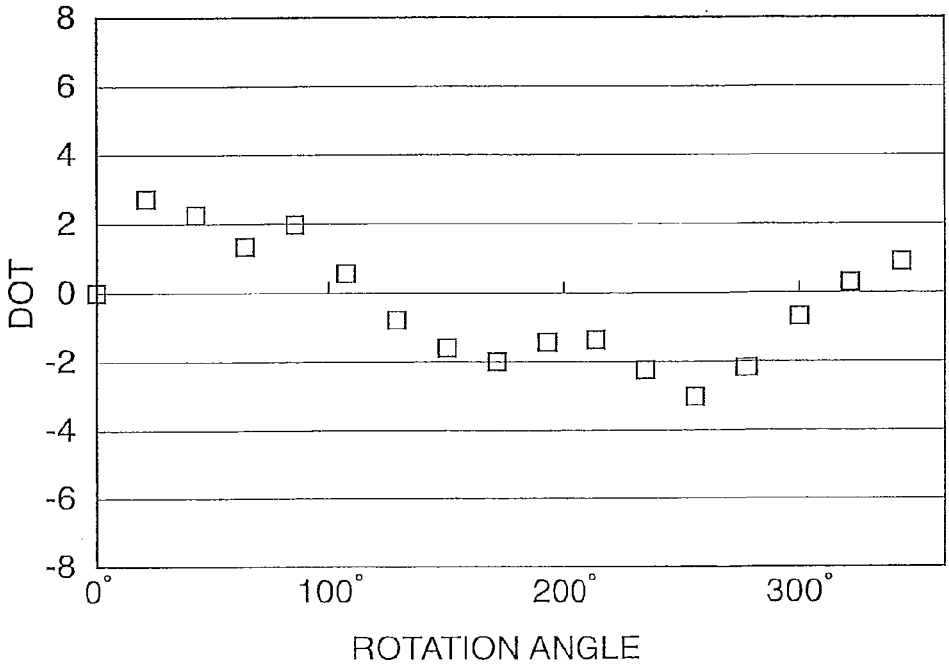
FIG. 19 is an explanation drawing of the sine-curve fitting method according to the present invention.
Figure 20:
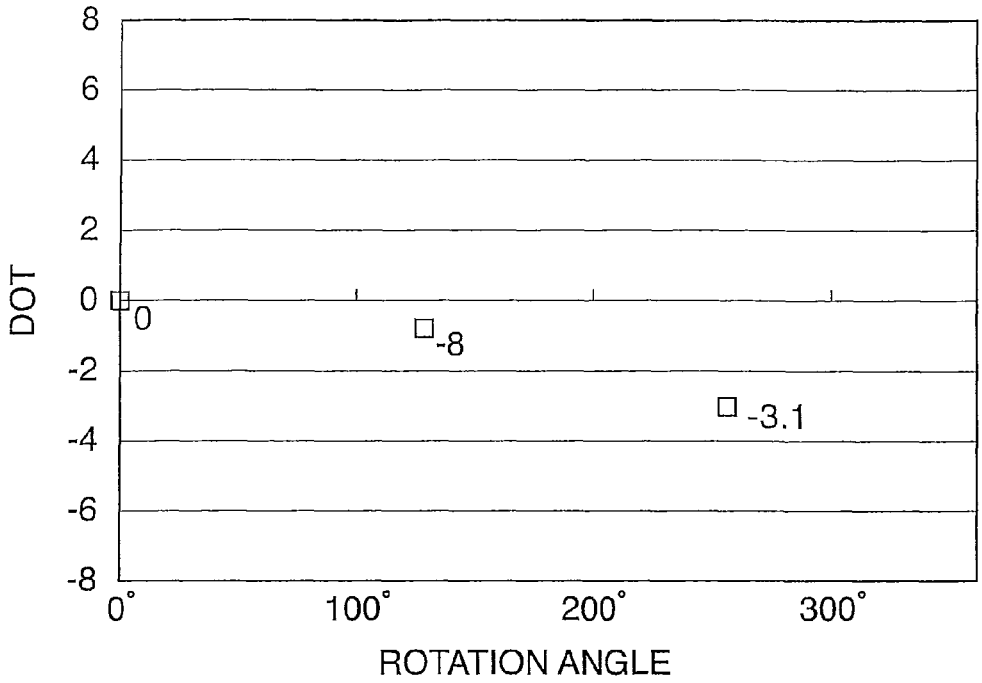
FIG. 20 is an explanation drawing of the sine-curve fitting method according to the present invention.

FIG. 19 is a measurement result of the deviations Δ1 to Δ17 in case where the test patterns are formed at 17 points including the three points of 0°, 120° and 240° in the rotation angle of 360° of the photosensitive drum. FIG. 20 shows the deviations 0, −0.8, −3.1 at the three points of 0°, 120° and 240° extracted from FIG. 19.

The following values are given by calculating the above-mentioned formulas using the data of FIG. 20.

a=1.33
b=1.30
A=1.86
τ=44.3°
τ=44.3°
C=−1.3

Figure 21:
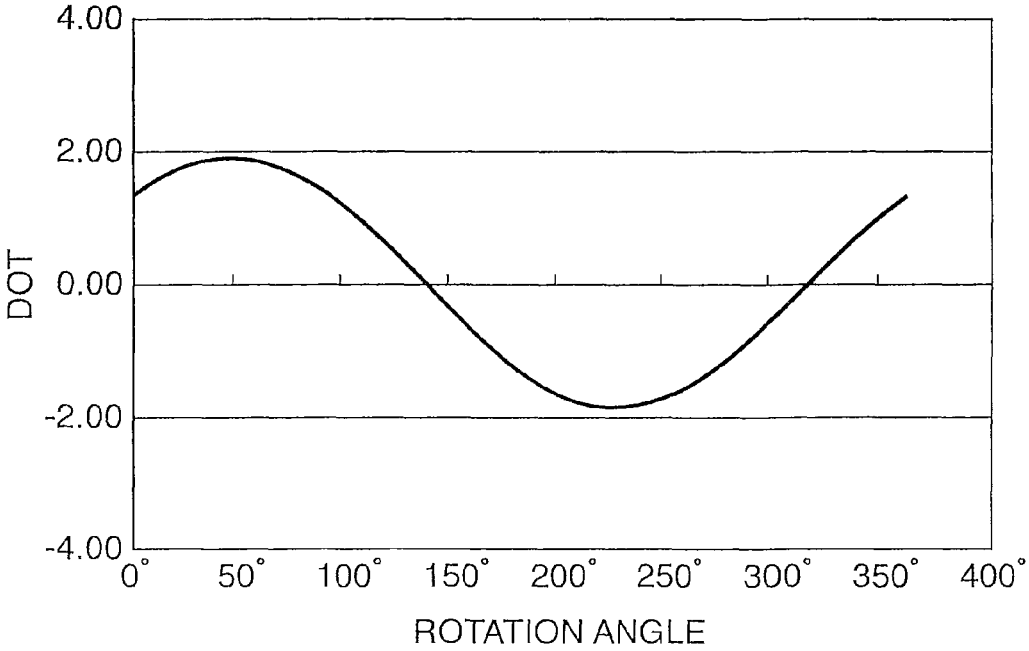
FIG. 21 is an explanation drawing of the sine-curve fitting method according to the present invention.

FIG. 21 is a reproduction wave (sine-curve) corresponding to these values. The sine-curve of FIG. 21 is drawn as C=0 so that it is apparently shown that the sine-curve is shifted by τ=44.3°.

Thus, the phase shift E against the reference position and the color registration error C along the sub scanning direction against the reference position are obtained. Therefore, if the image is shifted forward (to the direction of the rear side of the image) by C dots along the sub scanning direction, the image forming position is moved backward (to the front side of the image) to correct the color registration error. In another embodiment, when one color, for example, the black image forming position is set as a reference, the other color image forming positions may be adjusted so as to meet the black image forming position. For example, if the black image is shifted forward by 50 dots and the cyan image is shifted forward by 30 dots, the cyan image may be adjusted by shifting further forward by 20 dots so as to meet the black image forming position. The similar adjustment may be possible as to the yellow and magenta images.

Figure 12:
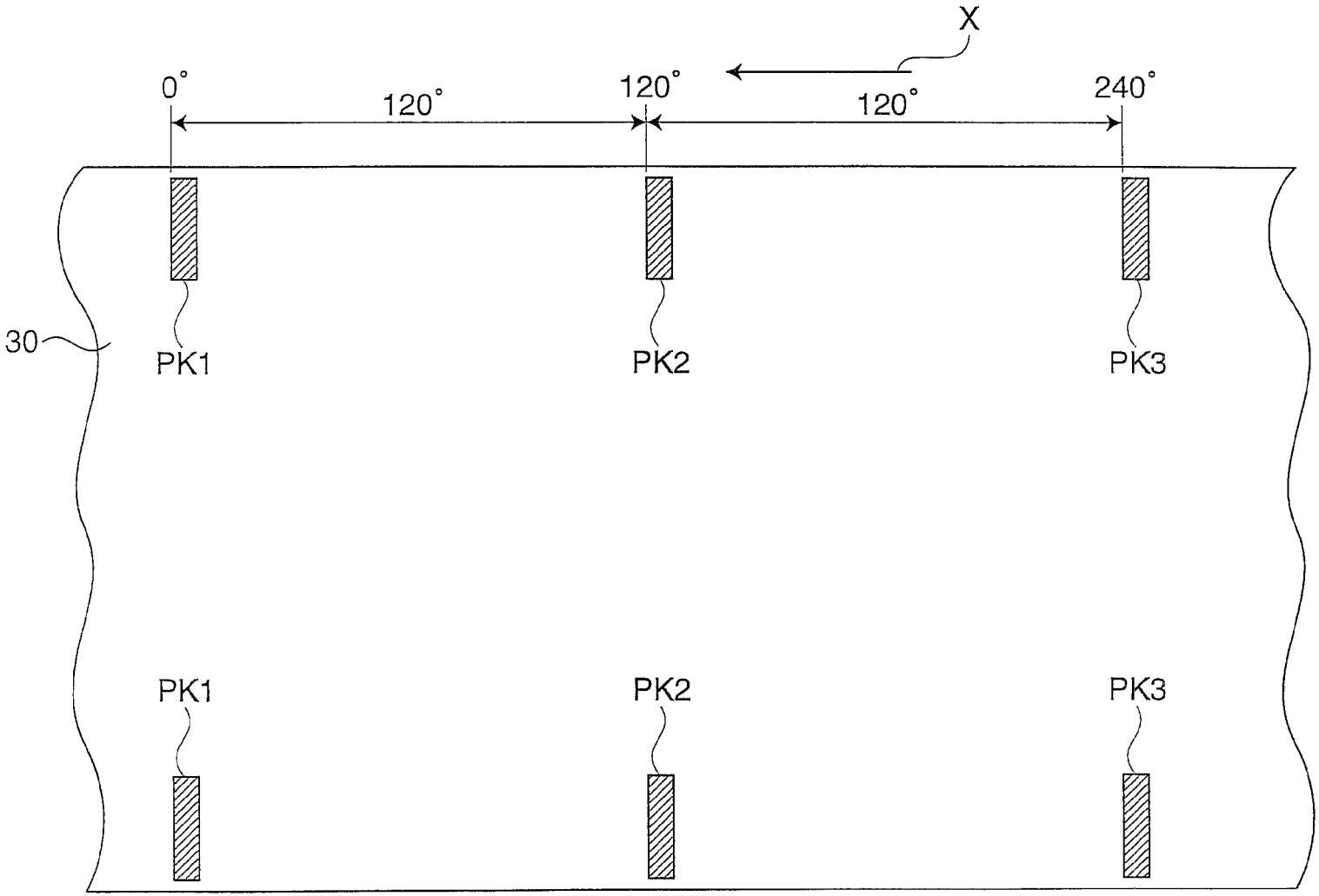
FIG. 12 is an explanation drawing of the primary part of the image forming apparatus of FIG. 1.

FIG. 12 is an example of black test patterns PK1 to PK3 at both edges of the belt 30 carried along the arrow direction X. In this case, a mean value of the calculated values a, b and C on one edge and the calculated values a, b and C on the other edge may be adopted.

Figure 13:
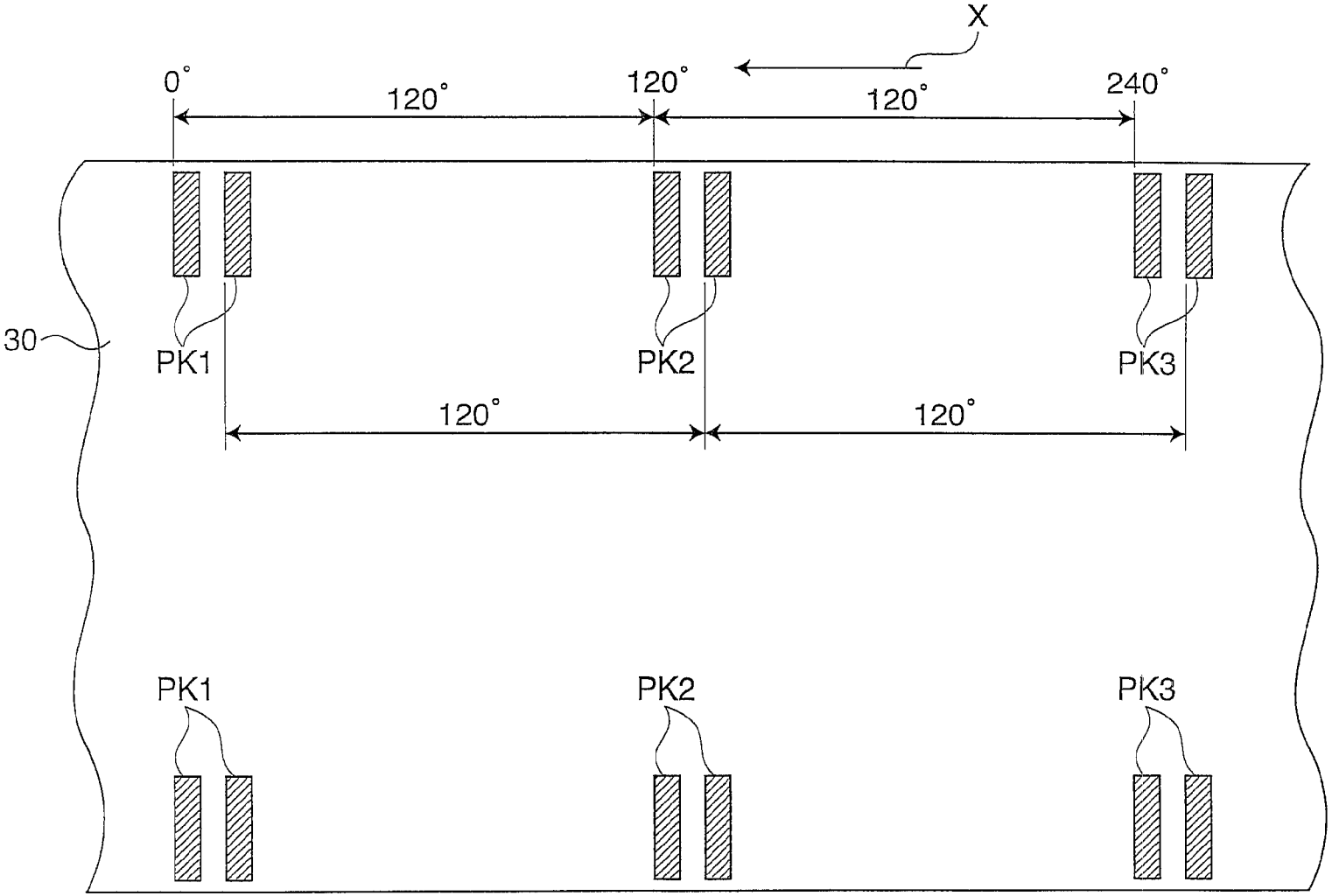
FIG. 13 is an explanation drawing of the primary part of the image forming apparatus of FIG. 1.

FIG. 13 is an example of a plurality of test patterns PK1 to PK3 of FIG. 12 along the sub scanning direction. In this case, a mean value of a first calculated values a, b and C and a second calculated values a, b and C may be adopted.

Figure 14:
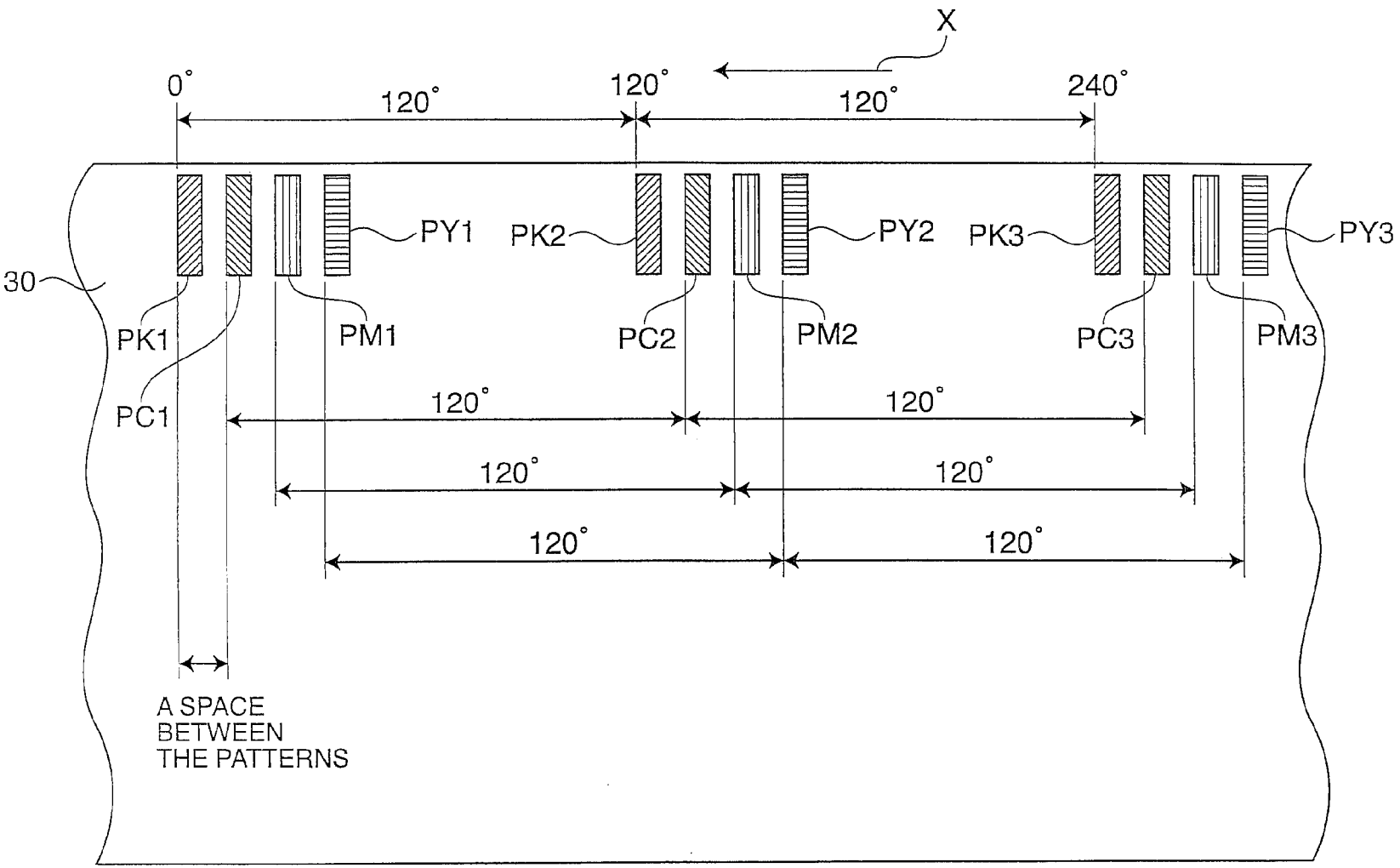
FIG. 14 is an explanation drawing of the primary part of the image forming apparatus of FIG. 1.

FIG. 14 is an example of four sets of test patterns (PK1, PC1 and PM1 and PY1), (PK2, PC2 and PM2 and PY2) and (PK3, PC3 and PM3 and PY3) for black, cyan, magenta and yellow. In this case, the values of a, b and C may be calculated for each four colors and adopted.

Figure 15:
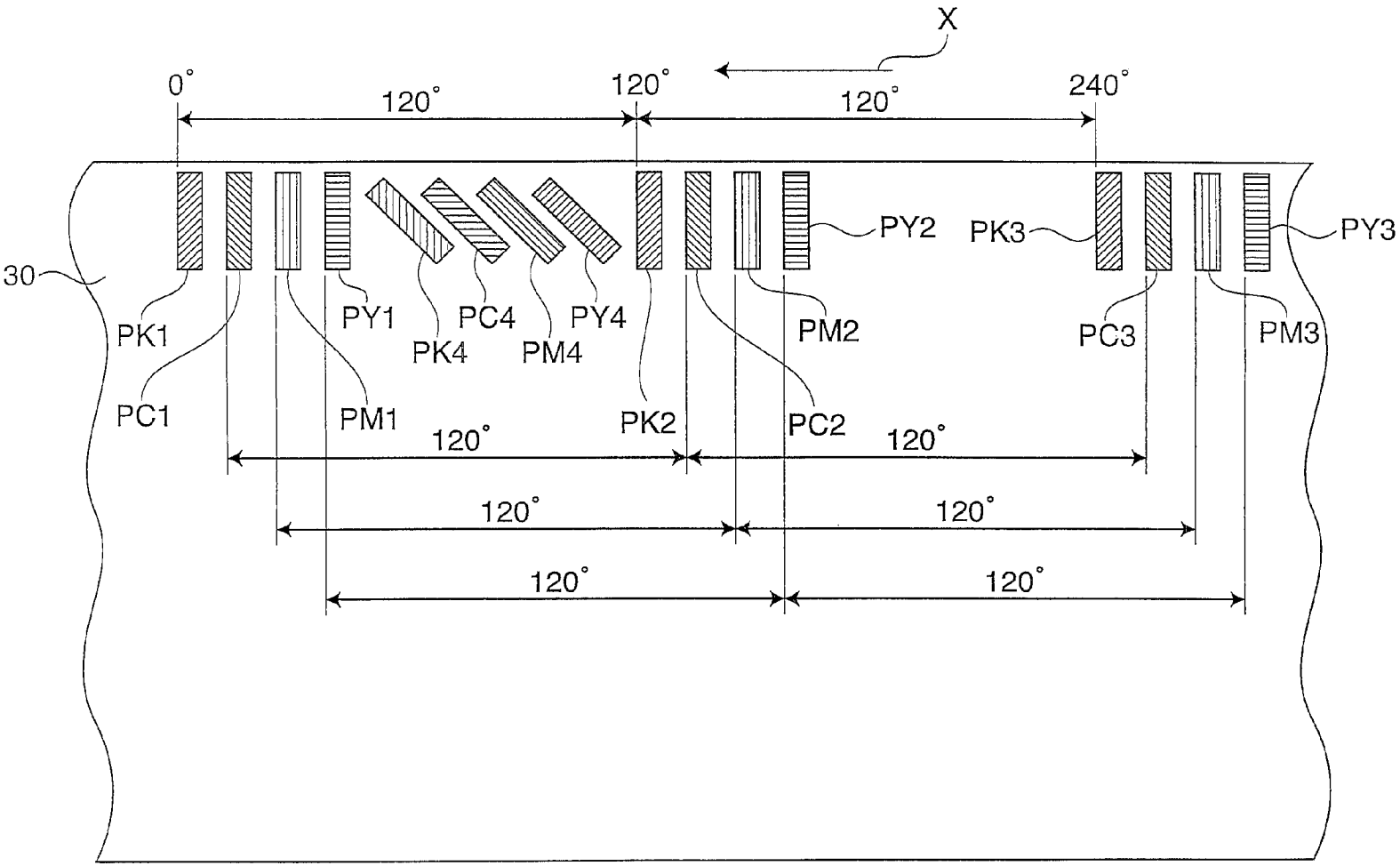
FIG. 15 is an explanation drawing of the primary part of the image forming apparatus of FIG. 1.

FIG. 15 is an example of adding a set of test patterns PK4, PC4 and PM4 and PY4 for the main scanning direction into the test patterns of FIG. 14. In this case, since the color registration error along the main scanning direction is generated and added to the color registration error C along the sub scanning direction previously determined, the color registration errors is first detected from the reference position and subtracted by the color registration error along the sub scanning direction previously determined, so that the color registration error along the main scanning direction may be determined.

Figure 16:
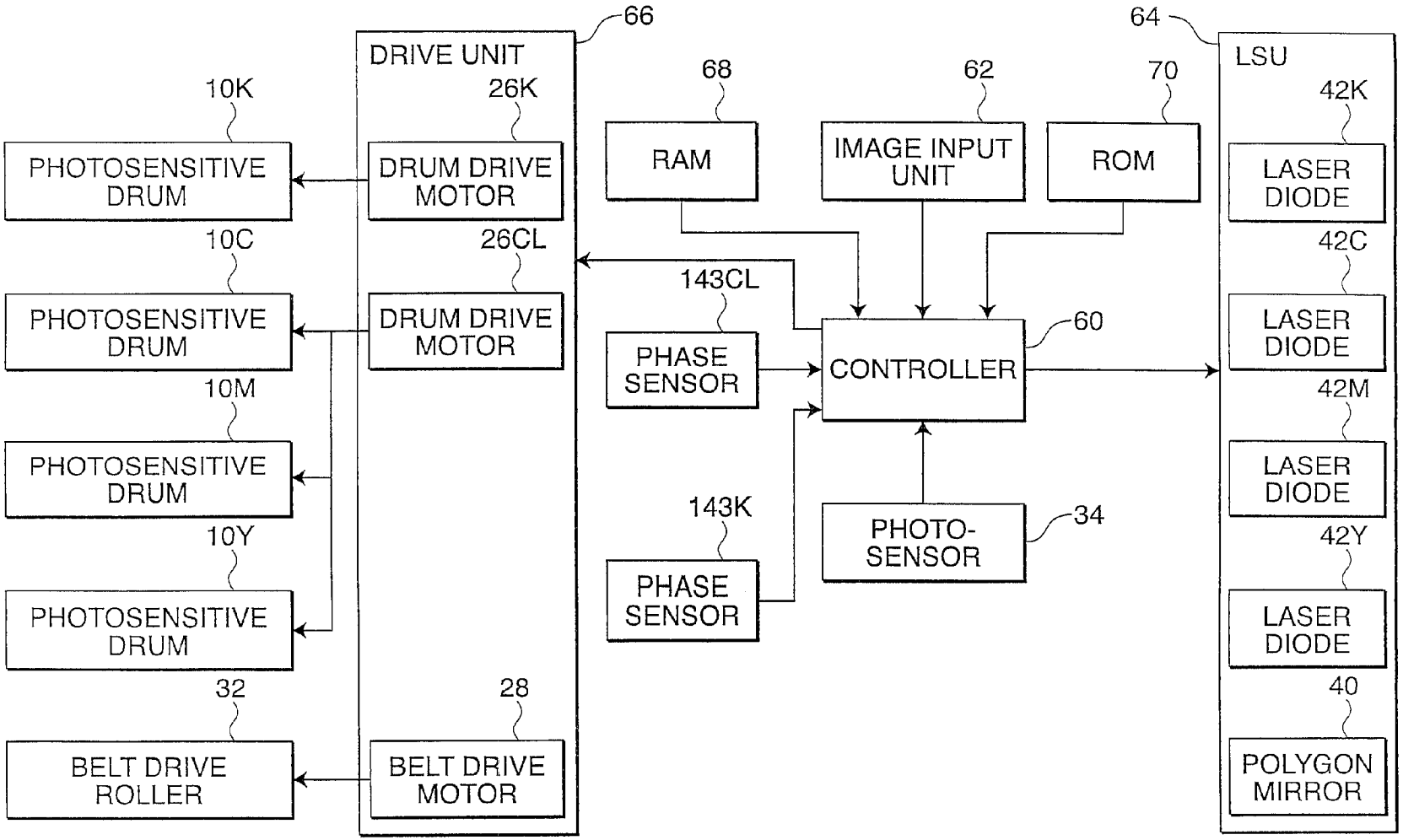
FIG. 16 is shows another embodiment of the present invention as corresponding to FIG. 2.

FIG. 16 shows another embodiment of the present invention as corresponding to FIG. 2, where the photosensitive drums 10C, 10M and 10Y are driven by a common drive motor 26CL. In this case, the phase sensors are replaced by a common phase sensor 143CL. The phase sensor 143CL may be provided for either of the photosensitive drums 10C, 10M and 10Y. The rotation phases of the photosensitive drums 10C, 10M and 10Y may be adjusted during their assembly at the factory so that they are not be changed in rotation phase thereafter. In this case, the present invention is applied so that the rotation phase of the black photosensitive drum 10K does not differ from the rotation phases of the other photosensitive drums 10C, 10M and 10Y.

Figure 17:
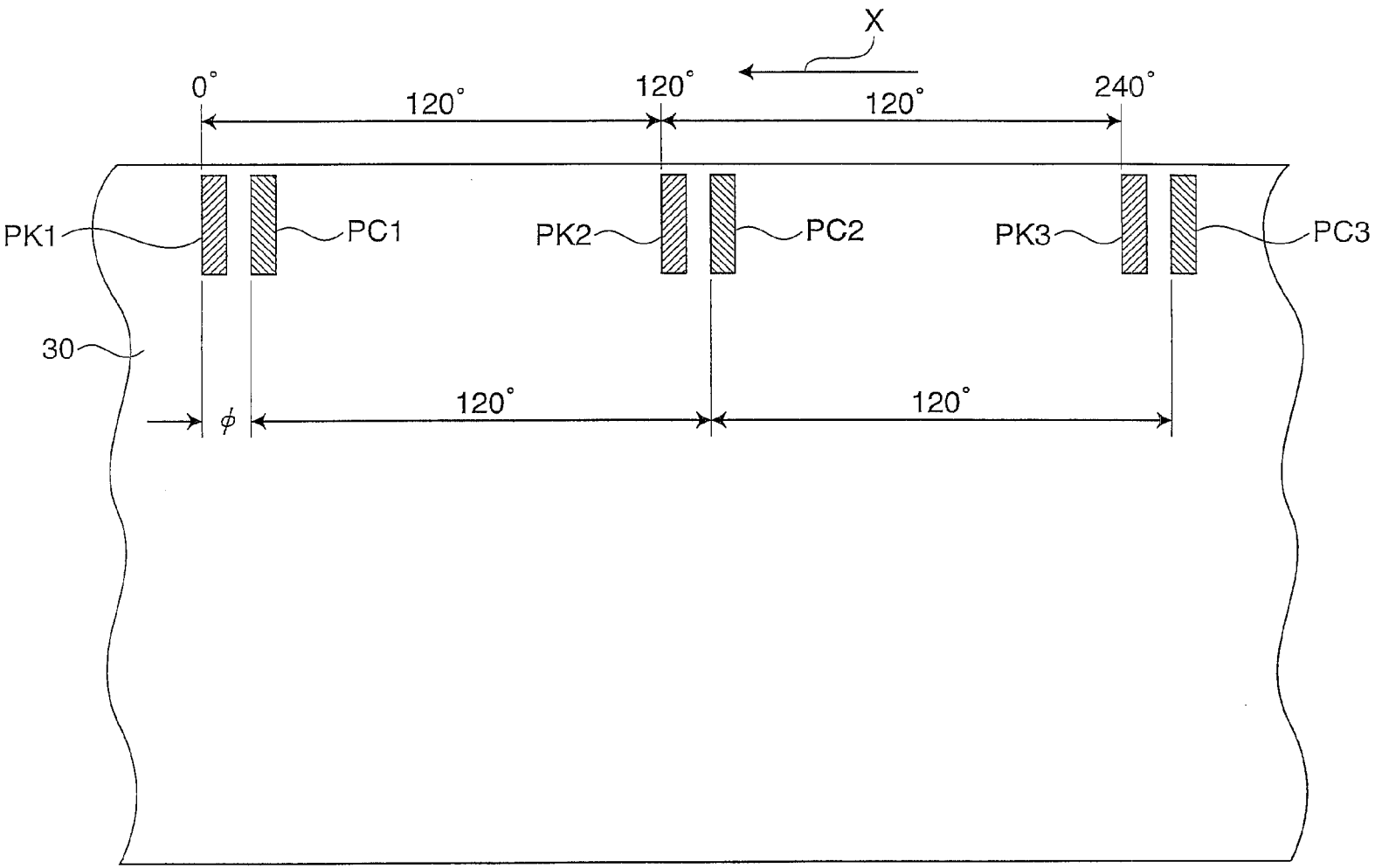
FIG. 17 is an explanation drawing of the primary part of the embodiment of the image forming apparatus of FIG. 16.

FIG. 17 is an example of the black test patterns PK1, PK2 and PK3 to control the phases of the black photosensitive drum 10K and the cyan test patterns PC1, PC2 and PC3 to control the phases of the three photosensitive drums 10C, 10M and 10Y in the embodiment of FIG. 16. To correct the alignment errors along the main scanning direction and the alignment errors along the sub scanning direction, it is necessary to detect the photosensitive drums 10C, 10M and 10Y. FIG. 17 shows an example of the test patterns for performing the phase control only.

What is claimed is:

1. An image forming apparatus comprising:

a plurality of photosensitive drums;

a latent image forming unit for forming an electrostatic latent image on each photosensitive drum;

a developing unit for developing each electrostatic latent image;

a transferring unit for superimposing and transferring the developed images onto a moving record medium;

a measurement unit for measuring positions of the transferred images on the record medium; and a control unit for controlling the photosensitive drums, the latent image forming unit, the developing unit and the transferring unit;

wherein the control unit includes:

a calculating unit for calculating a value related to alignment errors in the positions measured by said measurement unit in accordance with a sine-curve fitting method, the alignment error including at least one of a phase shift of each photosensitive drum with respect to a reference position and an alignment error in a sub scanning direction; and a correcting unit for correcting the alignment errors based on the calculated value.

2. The image forming apparatus according to claim 1, wherein each photosensitive drum is driven by an exclusive driving source.

3. The image forming apparatus according to claim 1, wherein the photosensitive drums comprise at least first, second and third photosensitive drums so that two of the photosensitive drums other than one are driven by a common driving source.

4. The image forming apparatus according to claim 1, further comprising:

a phase sensor for detecting a rotation phase of each photosensitive drum so that the control unit functions to confirm a correction result of the correcting unit in response to an output of the phase sensor.

5. The image forming apparatus according to claim 1, further comprising:

a phase sensor for detecting a rotation phase of each photosensitive drum, wherein the control unit adjusts a correction result of the correcting unit in response to an output of the phase sensor.

6. An image forming apparatus, comprising:

a plurality of photosensitive drums;

a latent image forming unit for forming an electrostatic latent image on each photosensitive drum;

a developing unit for developing each electrostatic latent image;

a transferring unit for superimposing and transferring the developed images onto a moving record medium;

a measurement unit for measuring positions of the transferred images on the record medium; and a control unit for controlling the photosensitive drums, the latent image forming unit, the developing unit and the transferring unit;

wherein the control unit includes:

a calculating unit for calculating a value related to alignment errors in the positions measured by said measurement unit in accordance with a sine-curve fitting method; and a correcting unit for correcting the alignment errors based on the calculated value, wherein the control unit allows the latent image forming unit, the developing unit and the transferring unit to carry out the steps of:

forming an electrostatic latent image having a test pattern on each photosensitive drum at every predetermined rotation angle;

developing each electrostatic latent image;

transferring the developed images on the record medium;

measuring a position y of each test pattern by the measurement unit;

representing the position y using a formula $y=A\sin(\theta+\tau)+C$ (where $\theta$ is a rotation angle of each photosensitive drum, t is a phase shift of each photosensitive drum with respect to the reference position, and C is an alignment error in the sub scanning direction) in accordance with the sine-curve fitting method to determine $\tau$ and C; and correcting the alignment errors on the record medium based on the determined $\tau$ and C.

7. The image forming apparatus according to claim 6, wherein the predetermined rotation angle is 120°.

8. The image forming apparatus according to claim 6, wherein the photosensitive drums comprise first and second photosensitive drums so that the test patterns are alternately formed on the moving record medium by the first and second photosensitive drums.

9. The image forming apparatus according to claim 6, wherein the photosensitive drums comprise first, second, third and fourth photosensitive drums so that the test patterns formed by the second, third and fourth photosensitive drums are formed on said moving record medium between the test patterns formed by the first photosensitive drum.

10. The image forming apparatus according to claim 6, wherein the test patterns are formed on both of edges of the moving record medium in a direction perpendicular to a moving direction of the record medium.

11. The image forming apparatus according to claim 6, wherein the test patterns slant to a moving direction of the record medium.

12. The image forming apparatus according to claim 6, wherein the predetermined rotation angle is determined so that a sum of values in a reference sine-wave corresponding to the test patterns becomes zero.

* * * * *